US006840292B2

(12) United States Patent
Hart et al.

(10) Patent No.: US 6,840,292 B2
(45) Date of Patent: Jan. 11, 2005

(54) APPARATUS AND METHOD TO CONTROL EXCESS PRESSURE IN FUEL STORAGE CONTAINMENT SYSTEM AT FUEL DISPENSING FACILITIES

(75) Inventors: Robert P. Hart, East Hampton, CT (US); Kent Reid, Canton, CT (US); Kevin Hughes, West Hardfort, CT (US)

(73) Assignee: Veeder-Root Company, Simsbury, CT (US)

( * ) Notice: Subject to any disclaimer, the term of this patent is extended or adjusted under 35 U.S.C. 154(b) by 77 days.

(21) Appl. No.: 10/382,021

(22) Filed: Mar. 5, 2003

(65) Prior Publication Data

US 2003/0230352 A1 Dec. 18, 2003

Related U.S. Application Data

(60) Provisional application No. 60/361,352, filed on Mar. 5, 2002.

(51) Int. Cl.[7] ..... B65B 1/04

(52) U.S. Cl. ..... 141/59; 141/95; 141/65

(58) Field of Search ..... 141/59, 65, 66, 141/67, 98, 95, 83, 63, 64

(56) References Cited

U.S. PATENT DOCUMENTS

| | | | | |
|---|---|---|---|---|
| 3,672,180 | A | 6/1972 | Davis | 62/54 |
| 4,842,027 | A | 6/1989 | Faeth | 141/45 |
| 4,967,809 | A | 11/1990 | Faeth | 141/59 |
| 5,040,576 | A | 8/1991 | Faeth | 141/45 |
| 5,040,577 | A | 8/1991 | Pope | 141/59 |
| 5,129,433 | A | 7/1992 | Faeth | 141/45 |
| 5,174,346 | A | 12/1992 | Healy | 141/226 |
| 5,178,197 | A | 1/1993 | Healy | 141/217 |
| 5,195,564 | A | 3/1993 | Spalding | 141/1 |
| 5,207,249 | A | 5/1993 | Healy | 141/59 |
| 5,240,045 | A | 8/1993 | Faeth | 141/1 |
| 5,269,353 | A | 12/1993 | Nanaji et al. | 141/59 |
| 5,305,807 | A | 4/1994 | Healy | 141/59 |
| 5,323,817 | A | 6/1994 | Spalding | 141/1 |
| 5,332,008 | A | 7/1994 | Todd et al. | 141/5 |
| 5,332,011 | A | 7/1994 | Spalding | 141/59 |
| 5,333,654 | A | 8/1994 | Faeth | 141/1 |
| 5,355,915 | A | 10/1994 | Payne | 141/83 |
| 5,417,256 | A | 5/1995 | Hartsell, Jr. et al. | 141/7 |
| 5,450,883 | A | 9/1995 | Payne et al. | 141/59 |
| 5,464,466 | A | 11/1995 | Nanaji et al. | 95/45 |
| 5,484,000 | A | 1/1996 | Hasselmann | 141/7 |
| RE35,238 | E | 5/1996 | Pope | 141/59 |
| 5,571,310 | A | 11/1996 | Nanaji | 96/4 |
| 5,592,979 | A | 1/1997 | Payne et al. | 141/59 |
| 5,626,649 | A | 5/1997 | Nanaji | 95/12 |
| 5,671,785 | A | 9/1997 | Andersson | 141/59 |
| 5,676,181 | A | 10/1997 | Healy | 141/59 |
| 5,678,614 | A | 10/1997 | Grantham | 141/59 |
| 5,755,854 | A | 5/1998 | Nanaji | 95/11 |
| 5,765,603 | A | 6/1998 | Healy | 141/59 |
| 5,782,275 | A | 7/1998 | Hartsell, Jr. et al. | 141/94 |
| 5,794,667 | A | 8/1998 | Payne et al. | 141/128 |
| 5,803,136 | A | 9/1998 | Hartsell, Jr. | 141/7 |

(List continued on next page.)

FOREIGN PATENT DOCUMENTS

| | | |
|---|---|---|
| EP | 0799790 | 4/1997 |
| GB | 2139598 | 5/1983 |

*Primary Examiner*—Steven O. Douglas
(74) *Attorney, Agent, or Firm*—Withrow & Terranova, P.L.L.C.

(57) ABSTRACT

A system and method for removing, compressing, and storing excess air and vapors from a fuel dispensing facility fuel storage containment system during periods of over-pressurization without venting or processing the excess air and vapors. The stored air and vapors are subsequently returned back to the containment system during periods of under-pressurization that typically occur diurnally during periods of high fueling activity. The system may be used to compliment an ORVR compatible dispensing system that typically encounters over-pressurization problems when low or no refueling activity is occurring.

26 Claims, 4 Drawing Sheets

U.S. PATENT DOCUMENTS 5,832,967 A 11/1998 Andersson ..... 141/59
5,843,212 A 12/1998 Nanaji ..... 96/4
5,857,500 A 1/1999 Payne et al. ..... 141/59
5,860,457 A 1/1999 Andersson ..... 141/59
5,878,792 A 3/1999 Pettazzoni et al. ..... 141/59
5,913,343 A 6/1999 Andersson ..... 141/59
5,944,067 A 8/1999 Andersson ..... 141/59
5,985,002 A 11/1999 Grantham ..... 94/47
5,988,232 A 11/1999 Koch et al. ..... 141/59
5,992,395 A 11/1999 Hartsell, Jr. et al. ..... 123/516
6,026,866 A 2/2000 Nanaji ..... 141/59
6,065,507 A 5/2000 Nanaji ..... 141/59
6,082,415 A 7/2000 Rowland et al. ..... 141/59
6,095,204 A 8/2000 Healy ..... 141/59
6,102,085 A 8/2000 Nanaji ..... 141/83
6,103,532 A 8/2000 Koch et al. ..... 436/55
6,123,118 A 9/2000 Nanaji ..... 141/4
6,151,955 A 11/2000 Ostrowski et al. ..... 73/40
6,167,747 B1 1/2001 Koch et al. ..... 73/19.03
6,167,923 B1 1/2001 Hartsell, Jr. ..... 141/192
6,182,714 B1 * 2/2001 Ginsburgh et al. ..... 141/63
6,236,295 B1 5/2001 Healy ..... 335/205
6,244,310 B1 6/2001 Rowland et al. ..... 141/59
6,247,508 B1 6/2001 Negley, III et al. ..... 141/94
6,293,996 B1 9/2001 Grantham et al. ..... 95/47
6,302,164 B1 10/2001 Nitecki et al. ..... 141/45
6,311,547 B1 11/2001 Nitecki ..... 73/40
6,325,112 B1 12/2001 Nanaji ..... 141/4
6,332,483 B1 12/2001 Healy ..... 141/59
6,334,470 B2 1/2002 Healy ..... 141/59
6,336,479 B1 1/2002 Nanaji ..... 141/4
6,338,369 B1 1/2002 Shermer et al. ..... 141/83
6,347,649 B1 2/2002 Pope et al. ..... 141/59
6,357,493 B1 3/2002 Shermer et al. ..... 141/59
6,360,785 B1 3/2002 Healy ..... 141/59
6,360,789 B2 3/2002 Walker et al. ..... 141/95
6,386,246 B2 5/2002 Pope et al. ..... 141/59
6,413,484 B1 7/2002 Koch ..... 423/245.3
6,418,981 B1 7/2002 Nitecki et al. ..... 141/4
6,460,579 B2 10/2002 Nanaji ..... 141/59
6,478,849 B1 11/2002 Taylor et al. ..... 95/11
6,499,516 B2 12/2002 Pope et al. ..... 141/59
6,532,999 B2 3/2003 Pope et al. ..... 141/59
2002/0000258 A1 1/2002 McCall et al. ..... 141/59

* cited by examiner

APPARATUS AND METHOD TO CONTROL EXCESS PRESSURE IN FUEL STORAGE CONTAINMENT SYSTEM AT FUEL DISPENSING FACILITIES

RELATED APPLICATION

This application claims the benefit of U.S. Provisional patent application Ser. No. 60/361,352, filed on Mar. 5, 2002.

FIELD OF THE INVENTION

The present invention relates to an apparatus and method for reducing volatile organic hydrocarbon (VOC) environmental pollution by controlling excess pressure in liquid fuel storage containment systems at gasoline dispensing facilities.

BACKGROUND OF THE INVENTION

Fuel storage containment systems at gasoline dispensing facilities (GDF's) (i.e. gasoline stations) suffer from over-pressurization caused by fuel vaporization and thermal expansion, especially with high volatility wintertime fuels. Over-pressurization can be the cause of polluting gaseous emissions of fuel components to the atmosphere, soil, and groundwater because the various parts of fuel storage containment systems at GDF's are rarely, if at all, perfectly tight. Most often leakage can occur through fueling nozzle valves, fittings, pipe junctions, relief valves, and seals. The problem can be exacerbated by the recent and ongoing proliferation of vehicles equipped with on-board refueling vapor recovery (ORVR) systems which can cause some types of existing fuel dispensers with vapor recovery capability to ingest excess air during vehicle refueling, thereby promoting more evaporation and pressurization in the containment system.

The problem is substantially reduced for fuel dispensers equipped with passive "balance" type vapor recovery systems. In this case, air and vapor ingestion is significantly restricted by the combination of a nozzle to vehicle fill pipe seal which exists during dispensing and the ORVR equipped vehicle vapor seal which exists within the ORVR system, thereby preventing return vapor or air flow back into the fueling nozzle and, therefore, the fuel storage containment system. Under these conditions liquid fuel is dispensed (removed) from the containment system and little or no fuel vapor or air is returned to the containment system so the vapor space increases without a corresponding increase in vapor and air mass. Therefore the pressure in the system tends to be reduced. This substantially alleviates the over-pressurization problem in the containment system. But when no or only a few ORVR vehicles are refueled over many hours, for instance, as typically can occur during nighttime at a GDF, the containment system can still become over pressurized as described above.

The problem is more severe for dispensers equipped with active "vacuum assist" type vapor recovery systems. In this case, when ORVR vehicles are refueled, there is no seal between the nozzle and the vehicle fill pipe. A dispenser vacuum pump creates a vacuum at the nozzle to draw in fuel vapors which, for non-ORVR vehicle refuelings, are normally expelled from the vehicle's tank. But for ORVR vehicle refuelings, vapors are not expelled from the vehicle. Therefore, ambient air is ingested into the fuel storage containment system in place of fuel-rich vapors. This air is returned by the vacuum pump and vapor piping to the containment system tank(s). The returned air promotes excessive liquid fuel vaporization within the tank(s), resulting in over-pressurization of the system. One improvement which can reduce this problem is disclosed in U.S. Pat. No. 5,782,275, Jul. 21, 1998, "Onboard Vapor Recovery Detection", Gilbarco, Inc. Another is disclosed in U.S. patent application Ser. No. 2002/0000258 A1, Jan. 3, 2002, "Dispenser with Radio Frequency On-Board Vapor Recovery Identification", Dresser Inc. This apparatus senses the absence of fuel vapors during refueling and shuts off the vacuum pump while refueling ORVR equipped vehicles. This significantly reduces the amount of air and residual vapors returned to the containment system during refueling. Therefore, an ORVR detection equipped vacuum assist dispenser affects the containment system in a similar manner as a balance type dispensing system, significantly reducing the over-pressurization problem.

Various other means have been disclosed in patents and are used in practice to effect similar outcomes in order to handle ORVR equipped vehicles without causing excessive over-pressurization of the fuel storage containment system. All of these types of apparatus and methods are considered to be various types of "ORVR compatible" systems.

But all of these systems suffer from a common problem. When there is little or no refueling activity, evaporation and thermal expansion can still occur, causing over-pressurization and subsequent slow leakage of polluting containments into the environment. The California Air Resources Board (CARB) has promulgated regulations addressing this general problem. The regulations appear under the general title of Enhanced Vapor Recovery (EVR) system requirements. In part, they require that the containment system pressures remain below certain levels relative to ambient atmospheric pressure to limit the amount of slow leakage of pollutants into the environment.

An existing solution to the problem is to add a "vapor processor" onto the containment system to remove excess air from the containment system ("membrane separators") or excess fuel vapors and air ("combustion systems"). But these methods are generally intended as high capacity, primary systems with capability beyond the needs of this residual over-pressurization problem and are expensive, complicated, and of limited reliability. They also emit low levels of pollution themselves during normal operation and have the potential to emit high levels of pollution under failure mode conditions. An example of such a device is shown in U.S. Pat. No. 5,985,002, Nov. 16, 1999, "Fuel Storage System with Vent Filter Assembly".

The disclosed invention solves this residual over-pressurization problem for ORVR compatible, vapor recovery dispensing systems by controlling and limiting excess containment system pressures during periods of low fueling activity. It does this in a simple, low cost, reliable manner and in normal operation, no pollutants are emitted by the apparatus. It is applicable to all the types of vapor recovery equipped dispensing systems described above.

OBJECT OF THE INVENTION

It is therefore an object of the present invention to provide a method and system for reducing excess positive pressure relative to ambient atmospheric pressure at a fueling facility for the purpose of reducing fuel storage containment system leakage of VOC's which are a type of air, soil, and groundwater pollution.

It is another object of the present invention to provide a method and system for compressing and storing in a small pressure vessel, excess vapor and air from a fuel storage containment system during limited periods of low or no refueling activity when fuel evaporation and thermal expansion are likely to raise the pressure in the containment system above ambient atmospheric pressure.

It is yet another object of the present invention to provide a method and system to take advantage of normally occurring periods of decreasing pressure in fuel storage containment system at a GDF with ORVR compatible dispensers by returning stored liquid and/or vapor and air back into the containment system without causing excessive positive pressures in the system.

It is still another object of the present invention to provide a method and system for reducing excess positive pressure relative to ambient atmospheric pressure within a fuel storage containment system at a GDF by using a compressor and storage system which emits no VOC pollution itself.

It is still a further object of the present invention to provide a low cost and reliable method and system for reducing excess positive pressure within a fuel storage containment system at a GDF with ORVR compatible dispensers by providing just enough capacity and capability to handle the very limited amounts of excess vapor which are slowly generated in such systems.

SUMMARY OF THE INVENTION

The invention provides a way to temporarily remove, compress, and store excess air and vapors from a GDF fuel storage containment system during periods of over-pressurization without venting or processing them. The system then returns the stored air and vapors back to the containment system during periods of under-pressurization which typically occur diurnally during periods of high fueling activity. It may be used to compliment an ORVR compatible dispensing system by providing a remedy to the low—or no—refueling activity period over-pressurization problem; however, the system can be used in systems that are not ORVR compatible or compliant.

In ORVR compatible systems, the invention relies on the ORVR compatible characteristics of the dispensing system, which produce low-pressure conditions during periods of high vehicle refueling activity so that it may periodically return the stored air and vapors without causing over-pressurization of the containment system.

Since a typical GDF fuel storage containment system with high volatility fuels operates in an over-pressure (nighttime), under-pressure (daytime) diurnal cycle, the removal of vapor and air mixture during the over-pressure portions of the cycle and return of mixture during the under-pressure portion of the cycle solves the over-pressure problem.

BRIEF DESCRIPTION OF THE DRAWINGS

The invention will be described in conjunction with the following drawings in which like reference numerals designate like elements and wherein.

DETAILED DESCRIPTION OF THE INVENTION

Figure 1:
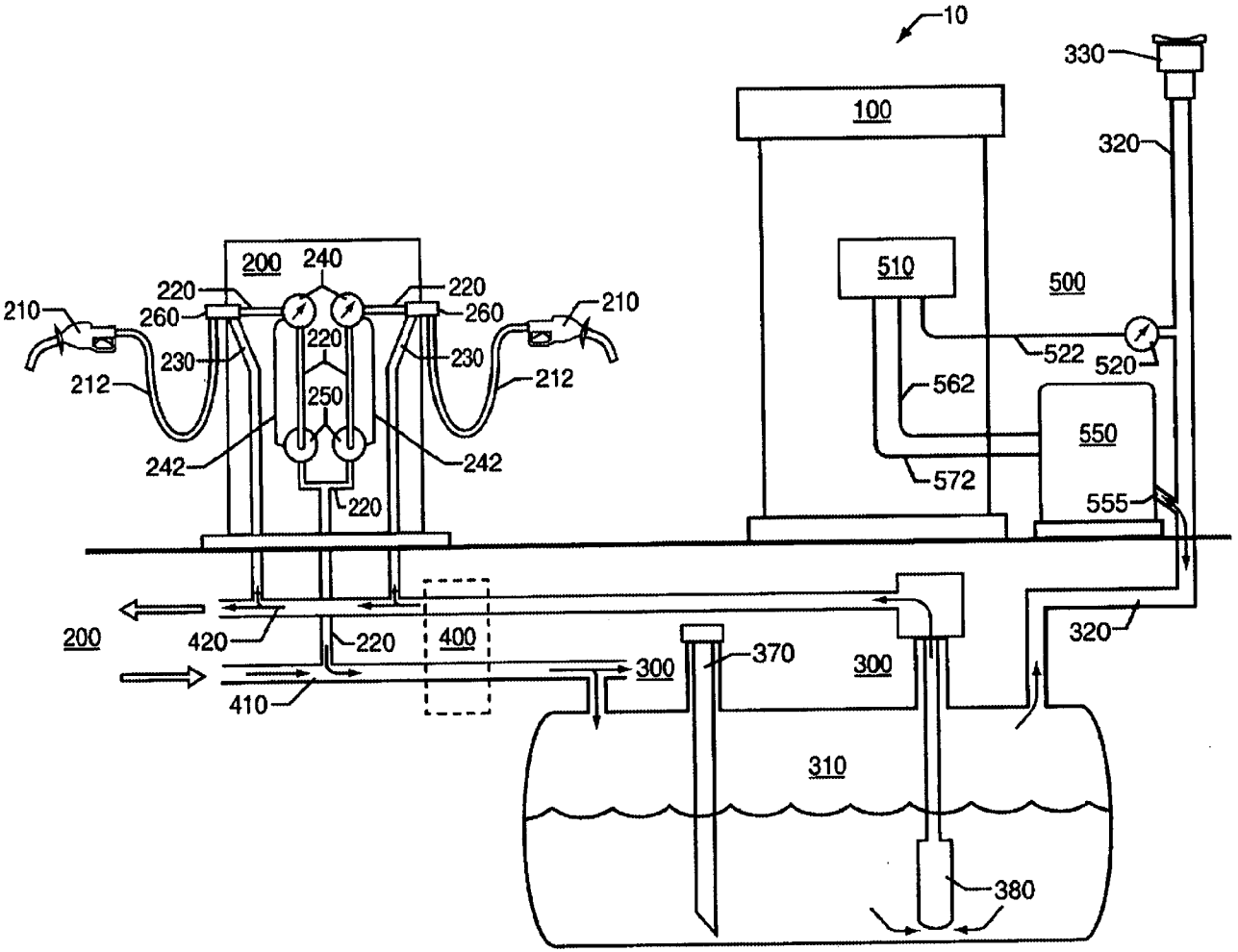
FIG. 1 is a schematic view of a fuel dispensing and fuel storage containment system with vapor recovery dispensers and a pressure controlling apparatus in accordance with an embodiment of the present invention.

An embodiment of the invention is described in connection with FIG. 1, which shows a fuel dispensing and fuel storage containment system with a vapor recovery dispenser and a pressure controlling apparatus 500 for use in a liquid fuel gasoline dispensing facility 10 (GDF). The GDF 10 may include a station house 100, one or more fuel dispenser units 200, a fuel storage containment system 300, means for connecting the dispenser units 200 to the main fuel storage system 400, and a pressure controlling apparatus 500. The main fuel storage system 400 can be used interchangeably with fuel storage containment system 300 for the purpose of measuring pressure as described for the present invention since the vapor return pipe 410 is fluidly coupled to the fuel storage containment system 300.

The fuel dispenser units 200 may be provided in the form of conventional "gas pumps." Each fuel dispenser unit 200 may include one or more fuel dispensing points typically defined by the nozzles 210 and hoses 212. The fuel dispenser units 200 may include one hose 212, one coaxial vapor/liquid splitter 260, one vapor return passage 220, and one fuel supply passage 230 per nozzle 210.

The vapor return passages 220 may be joined together before connecting with a common vapor return pipe 410. The vapor return passages 220 may optionally include a single vacuum assist pump 250 per dispensing point. Vapor recovery dispensers 200 with vacuum assist pumps 250 are typically called "vacuum assist dispensers". Vapor recovery dispensers 200 without vacuum assist pumps 250 are typically called "balance dispensers".

When the vapor return passages 220 include optional vacuum assist pumps 250, they may also optionally include a single On-board Refueling Vapor Recovery (ORVR) vehicle detection device 240 per dispensing point. Each detection device 240 may be electrically connected to a vacuum assist pump 250 by an electrical connector 242. The detection device 240 controls the vacuum assist pump 250 by deactivating it during vehicle refueling activity when an ORVR vehicle is detected by the detection device 240. The purpose of this detection and control is described below.

The fuel storage containment system 300 may include one or more fuel storage tanks 310. It is appreciated that the storage tanks 310 may typically be provided underground; however, underground placement of the tank is not required for application of the invention. It is also appreciated that the storage tank 310 shown in FIG. 1 may represent a grouping of multiple storage tanks tied together into a storage tank network. Each storage tank 310, or a grouping of storage tanks, may be connected to the atmosphere by a vent pipe 320. The vent pipe 320 may terminate in a pressure relief valve 330.

A basic premise of the system 10 is that it includes a vapor storage system 550 which is the operative part of the pressure controlling apparatus 500 connected with a single pipe 555 to the vent pipe 320 intermediate of the storage tank 310 and the pressure relief valve 330. A pressure sensor 520 which is also part of the pressure controlling apparatus 500 may be operatively connected to the vent pipe 320. Alternately, it may be connected directly to the storage tank 310 or the vapor return pipe 410 below or near to the dispenser 200 since the pressure is normally substantially the same at all these points in the vapor containment system.

A controller 510 which is also part of the pressure controlling apparatus 500 may be located in the station house 100 or alternatively (not shown) in or near the vapor storage system 550 housing. The controller 510 may be a tank monitoring device, such as the Veeder-Root TLS-350, or may be a point-of-sale controller, such as the G-Site® manufactured by Gilbarco Inc. The controller 510 may be electrically connected to the pressure sensor 520 by an electrical connector 522 and may be electrically connected to the vapor storage system 550 by electrical connectors 562 and 572.

The storage tank 310 may also include a fill pipe and fill tube 370 to provide a means to fill the storage tank 310 with fuel and a submersible pump 380 to supply the dispensers 200 with fuel from the storage tank 310.

The means for connecting the dispenser units 200 and the fuel storage containment system 400 may include one or more vapor return pipelines 410 and one or more fuel supply pipelines 420. The vapor return pipelines 410 and the fuel supply pipelines 420 are connected to the vapor return passages 220 and fuel supply passages 230, respectively, associated with multiple fuel dispensing points 210. As such, a "vapor return pipeline" designates any return pipeline that carries the return vapor of two or more vapor return passages 220.

Operation of the pressure controller apparatus 500 is described in connection with FIG. 2, which shows the components of the vapor storage system 550. The flowchart diagrams in FIGS. 3A and 3B show the operation of the controller 510 in connection with the components of the vapor storage system 550 illustrated in FIG. 2.

Figure 2:
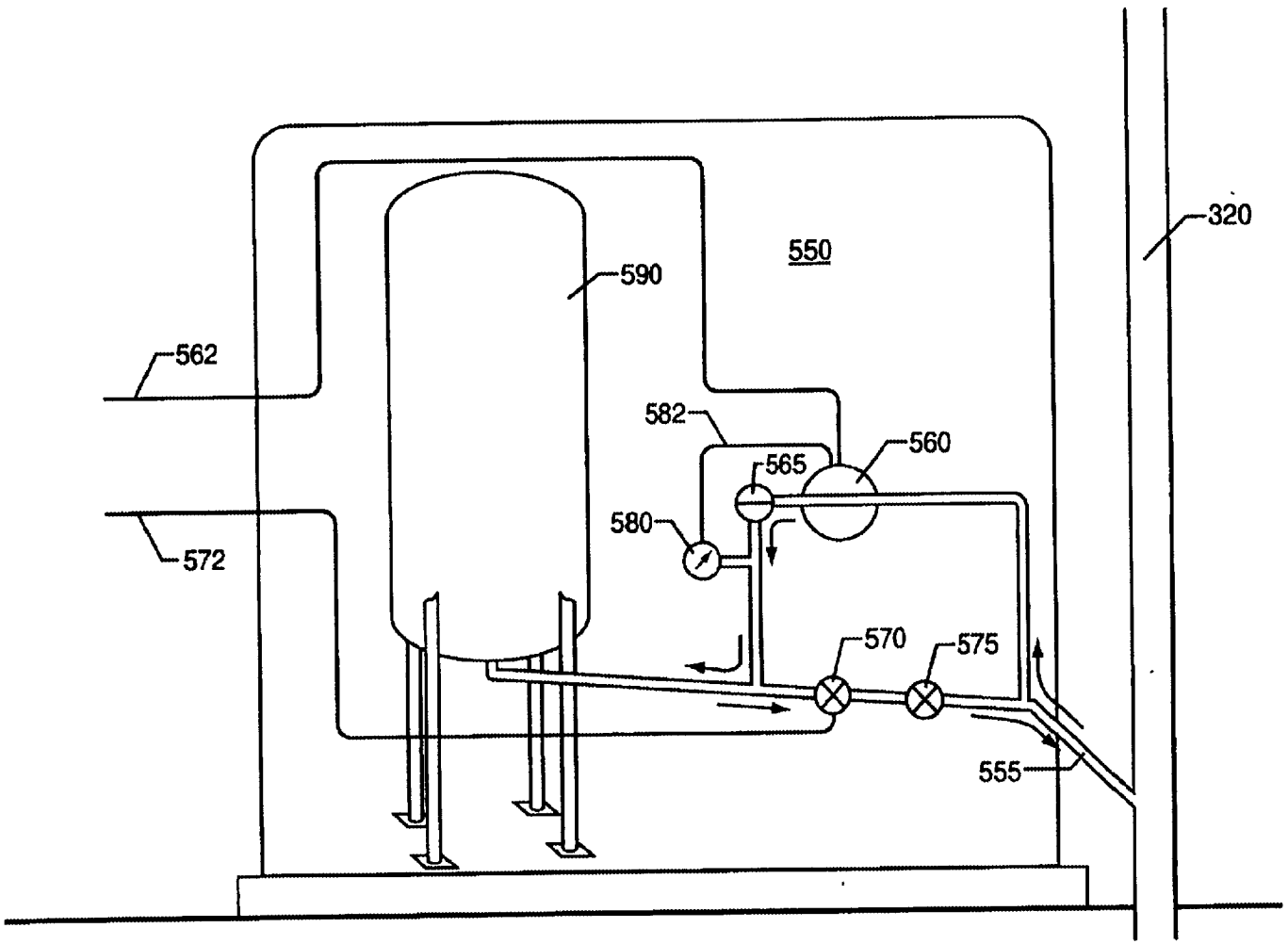
FIG. 2 is a schematic view of a pressure controlling apparatus showing components of the apparatus in accordance with an embodiment of the present invention.
Figure 3A:
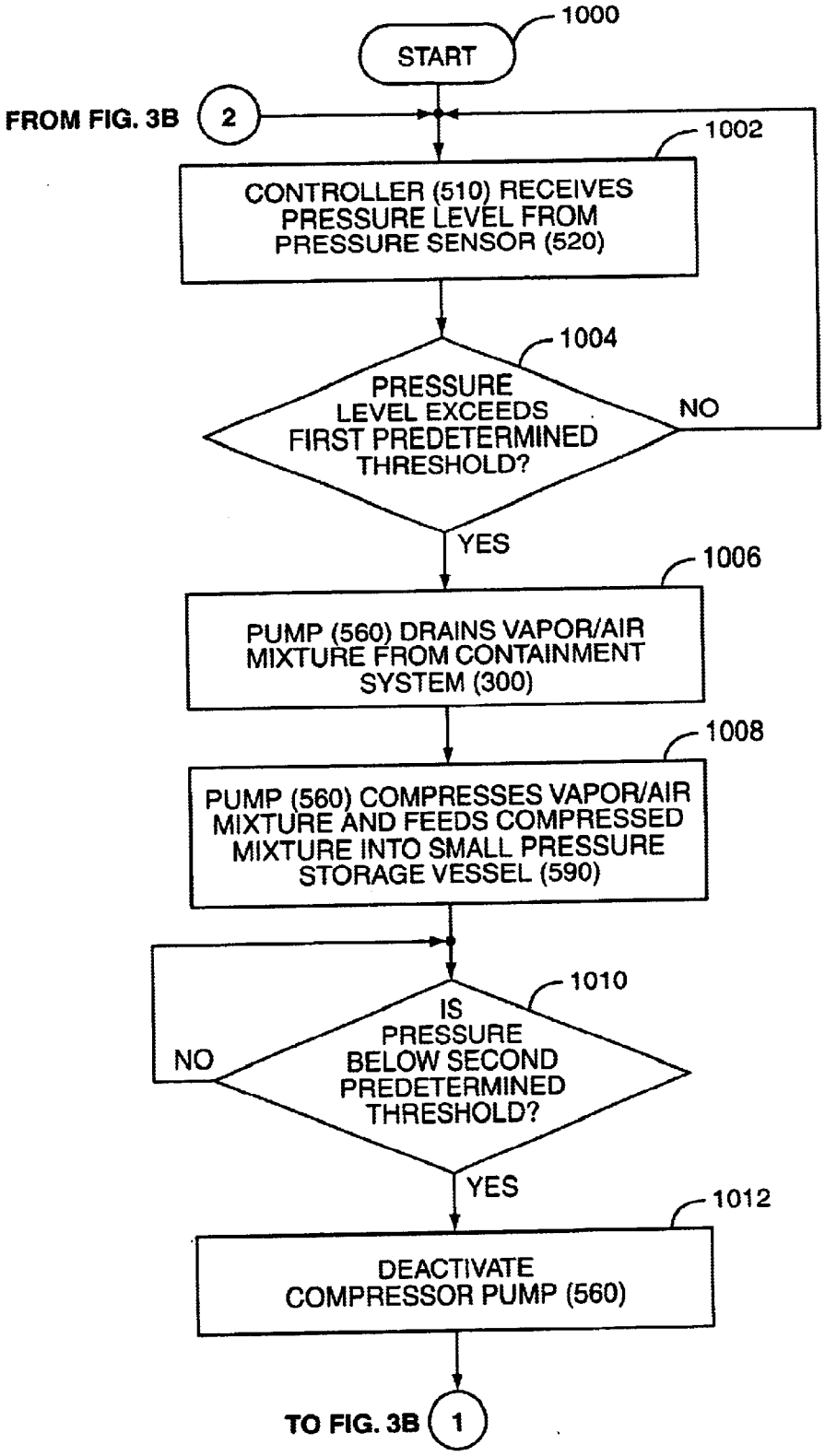
FIG. 3A is a flowchart diagram of the operation of one embodiment of the invention.
Figure 3B:
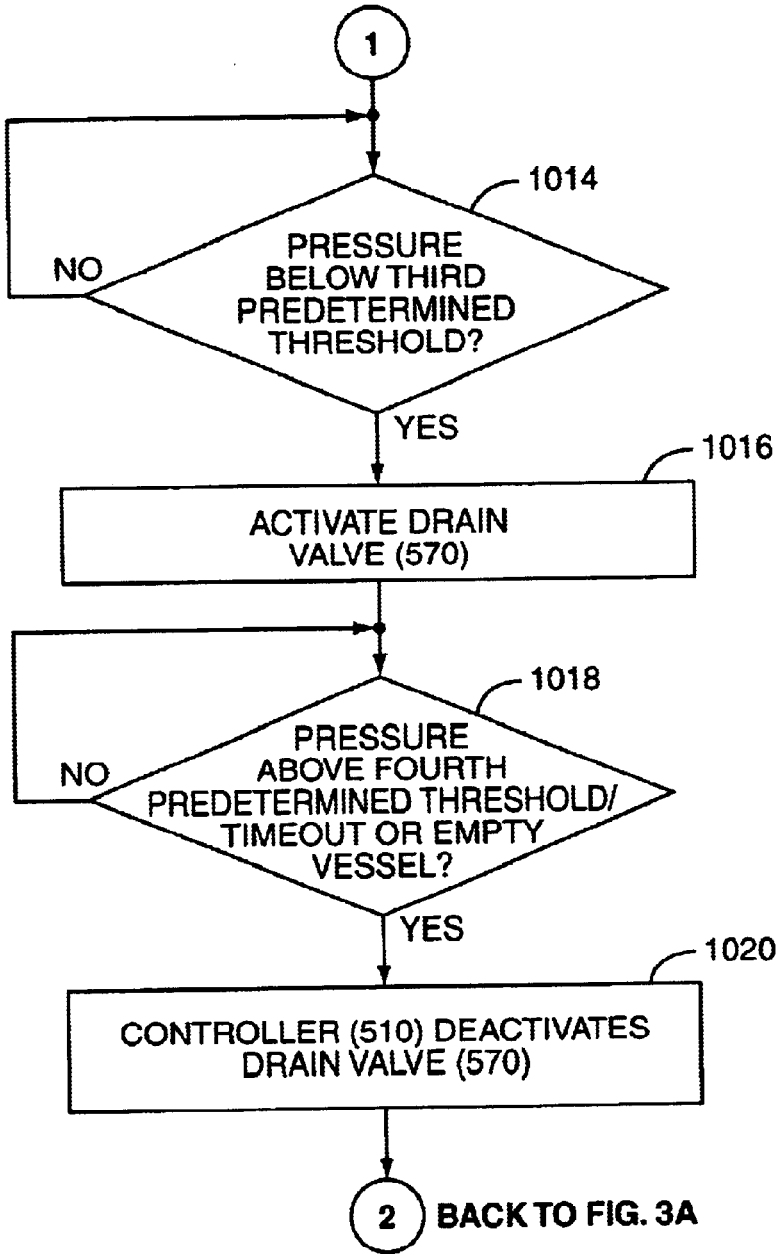
FIG. 3B is a flowchart diagram that is an extension of the flowchart diagram in FIG. 3A.

Turning to the flowchart diagrams in FIGS. 3A and 3B with respect to FIG. 2, the process starts (step 1000), and the controller 510 frequently and periodically measures containment system 300 pressure relative to ambient atmospheric pressure using a pressure sensor 520 (step 1002). Under conditions of low or no dispensing activity, and with high volatility fuels, fuel storage containment systems 300 will generally experience slowly rising pressures due to evaporation and/or thermal expansion of vapors. When this occurs and the pressure exceeds a first predetermined threshold of approximately +0.6 inches of water column ("wc), the controller 510, which may be electrically connected to a compressor pump 560 motor by an electrical connector 562, activates the compressor pump 560 motor (decision 1004). The pump 560 draws the vapor and air mixture from the containment system 300 via a single connecting pipe 555 (step 1006). The single connecting pipe 555 may be connected to any convenient point of the containment system 300 with access to the vapor space including a vent pipe 320, a tank access port in the tank 310, vapor space manifold piping 410 between multiple tanks 310, return vapor piping 410 from the dispenser(s) 200, or vapor return piping 220 within a dispenser 200.

The pump 560 compresses the vapor and air mixture from the containment system 300 and feeds the compressed mixture into a small pressure storage vessel 590 of approximately 1 or 2 cubic feet (cu-ft) capacity (step 1008). As the mixture is drawn from the containment system 300, the pressure in the system will typically drop. When the pressure, as measured by the pressure sensor 520, drops below a second predetermined threshold of approximately +0.2" wc (decision 1010), the controller 510, which is electrically connected to the compressor pump 560 motor by the electrical connector 562, deactivates the compressor pump 560 motor (step 1012). The compressed mixture remains temporarily stored within the pressure storage vessel 590 at high pressure up to approximately 100 or 200 or more pounds per square inch (psi). If the compressor pump 560 does not include an inherent means to prevent back flow at high pressure, an optional check valve 565 may be added in series with the pump 560 to prevent back flow through the pump 560 while it is off.

The process of compressing the vapor and air mixture may cause some condensation of vapor into a liquid state. In this case both vapor and liquid are pumped into the storage vessel 590.

ORVR compatible dispensers 200 will generally produce low pressure conditions in the containment system 300 during periods of high vehicle refueling activity. When this occurs and the fuel storage containment system 300 pressure drops below a third predetermined threshold of approximately −0.6" wc (decision 1014 from FIG. 3B), the controller 510, connected to a solenoid operated drain valve 570 by an electrical connector 572, activates the drain valve 570 which bypasses the compressor pump 560 and allows controlled return flow of stored liquid and/or vapor from the pressure storage vessel 590 back into the containment system 300 via the single connecting pipe 555 (step 1016). The flow is driven by the difference in pressure between the storage vessel 590 and the containment system 300.

Since some liquid fuel may be present at the bottom of the storage vessel 590, the vessel 590 is drained from the bottom rather than the top to allow its return in a liquid state. This can be effected by mounting the vessel 590 with the entry port at the bottom, or by using a fill/drain tube within the vessel (not shown), or other means. The storage and return process capacity is improved for a given vessel 590 size and working pressure limit by allowing the liquid to return to the containment system 300 in liquid rather than vapor form, which would take up much more space. Porting from the vessel 590 top would allow complete evaporation of the liquid as the pressure drops back near ambient atmospheric pressure levels. Some evaporation may occur even when liquid is fed to the drain valve 570, depending upon the stored liquid temperature, due to the large pressure drop which occurs when the liquid is returned to the containment system 300.

An optional pressure regulator 575 can be included in the drain piping in series with the drain valve 570 to regulate and limit the pressure of the draining liquid and/or vapor to prevent excessive pressures in the single connecting pipe 555 and any part of the fuel storage containment system 300 during the draining period.

When or if the fuel storage containment system 300 pressure increases above a fourth predetermined threshold of approximately −0.2" wc (decision 1018), the controller 510 deactivates the solenoid operated drain valve 570 which halts the flow of liquid or vapor and air back into the containment system 300, preventing further increase in containment system 300 pressure and leaving it at a reasonably low level (step 1020). Additionally, since the storage vessel 590 may drain completely before the containment system 300 pressure reaches the fourth threshold, a predetermined timeout is implemented in the controller 510 to also deactivate the drain valve 570. Alternately, an optional second pressure sensor (not shown) can be used by the controller 300 to measure the storage vessel 300 pressure and shut off the drain valve 570 when pressure reaches a lower threshold signifying an empty vessel 590.

An over-pressure safety shutoff switch 580, which may be connected to the compressor pump 560 motor by an electrical connector 582, senses pressure within the high pressure side of the piping between pump 560 (or if present, optional check valve 565) and drain valve 570 and storage vessel 590. If or when the pressure exceeds a predetermined upper working limit, the safety shutoff switch 580 opens, which by means of the electrical connector 582, disconnects power from the compressor pump 560 motor which deactivates the pump 560 preventing excessive pressure from building up inside the storage vessel 590 and related components. Although safety shutoff defeats use of the apparatus 500 in keeping containment system 300 pressures from exceeding the first pressure threshold limit, it is expected that this is a rare and abnormal condition which will not materially affect long term averages of positive containment system 300 pressures. Since CARB requirements are generally based on weekly or monthly long-term averages, no adverse consequences will likely occur.

Since fuel vapor and air mixtures pose a flammability safety hazard, all the electrical components, including compressor pump 560 motor, solenoid activated drain valve 570, pressure sensor 520, pressure switch 580, and associated electrical connectors, 582, 522, 562, 572 are designed as either intrinsically safe circuits and devices or are enclosed in explosion proof housings as appropriate to ensure safety.

The capacity of the pressure storage vessel 590 and the maximum working pressure capability of the vessel 590 and other components 560, 565, 580, 570 of the vapor storage system 550 determine the maximum volume of vapor and air mixture which may be removed from the containment system 300 during any one over-pressure, under-pressure cycle of the containment system 300. For instance, if the vessel 590 capacity is 1 cu-ft and maximum working pressure capability of the components is 150 psi (about 10 atmospheres), then up to about 10 cu-ft of vapor and air mixture can be removed from the containment system 300 before some or all of the compressed mixture must be retuned to the system 300. Based on measurements taken from multiple GDF fuel storage containment systems 300 over long periods of time, the maximum volume of vapor and air mixture which must be removed from the systems 300 to remain within CARB required pressure limits is approximately 10 or 20 cu-ft. Since some of the fuel vapor may be reduced to liquid form, actual storage capacity will be larger than that described in the above example.

Also, the storage system 550 piping, fittings, and structural members may be arranged in such a manner as to provide easy add-on connection means to connect and mount additional pressure storage vessels 590 so that storage capacity may be increased if needed at any particular GDF.

It will be apparent to those skilled in the art that various modifications and variations can be made in the construction and configuration of the foregoing embodiments of the invention without departing from the scope or spirit of the invention. For example, the specific pressures disclosed for triggering the operation of the pressure controller apparatus 500 may be varied without departing from the intended scope of the invention. Furthermore, the size, shape, location, capacity, powering, and monitoring of the pressure controller apparatus 500 may be varied without departing from the intended scope of the invention.

We claim:

1. A vapor storage system for compressing and air or vapor mixture from a fuel storage containment system to reduce the pressure in the fuel storage containment system when the fuel storage containment system is over-pressurized, comprising:

a pressure sensor that measures the pressure level in the fuel storage containment system;

a controller, wherein said controller is electrically coupled to said pressure sensor to receive the pressure level in the fuel storage containment system; and a compressor pump electrically connected to said controller and under control of said controller wherein said compressor pump is fluidly coupled to the fuel storage containment system;

a storage vessel fluidly coupled to said compressor pump;

said controller activates said compressor pump to draw the air or vapor mixture from the fuel storage containment system when the pressure level from said pressure sensor exceeds a first threshold pressure level and said compressor pump stores the compressed air or vapor mixture in said storage vessel.

2. The system of claim 1, wherein said first threshold pressure level is approximately +0.6 inches of water column.

3. The system of claim 1, wherein said compressor pump is fluidly coupled to a component of the fuel storage containment system comprised from the group consisting of the fuel storage tank, the vent pipe, and the vapor return pipe.

4. The system of claim 1, further comprising a check valve between said compressor pump and said storage vessel to prevent backflow of the air or vapor mixture from said storage vessel to said compressor pump.

5. The system of claim 1, wherein said controller deactivates said compressor pump when the pressure level in the fuel storage containment system drops below a second threshold pressure level.

6. The system of claim 1, wherein said second threshold pressure level is approximately +0.2 inches water column.

7. The system of claim 5, further comprising a connecting pipe fluidly coupling said storage vessel to the fuel storage containment system and a drain valve that is electrically coupled to said controller and is located in said connecting pipe between said storage vessel and the fuel storage containment system, wherein said controller causes said drain valve to open when the pressure level in the fuel storage containment system falls below a third threshold pressure level to release the air or vapor mixture in said storage vessel back into the fuel storage containment system to raise the pressure level in the fuel storage containment system.

8. The system of claim 7, wherein said third threshold pressure level is approximately −0.6 inches water column.

9. The system of claim 7, wherein said controller deactivates said drain valve when the pressure level in the fuel storage containment system exceeds a fourth threshold pressure level.

10. The system of claim 9, wherein said fourth threshold pressure level is approximately −0.2 inches water column.

11. The system of claim 7, wherein said controller deactivates said drain valve after a predetermined amount of time.

12. The system of claim 7, wherein said controller deactivates said drain valve when said controller determines that said storage vessel is empty.

13. The system of claim 12, wherein said controller determines said storage vessel is empty by receiving a pressure signal that reaches a low pressure threshold level from a second pressure sensor located in said storage vessel to measure the pressure level inside said storage vessel.

14. The system of claim 7, further comprising a pressure regulator located in said connecting pipe between said drain valve and the fuel storage containment system that regulates and limits the pressure of the air or vapor mixture to prevent excessive pressures in said connecting pipe and the fuel storage containment system when the air or vapor mixture is drained from said storage vessel to the fuel storage containment system.

15. The system of claim of claim 1, further comprising a safety shutoff switch coupled to the outlet side of said compressor pump and electrically connected to said compressor pump, wherein said safety shutoff switch deactivates said compressor pump if the pressure in said storage vessel exceeds a predetermined upper pressure level to prevent excessive pressure from building up inside said storage vessel.

16. A method of managing the pressure level of the air or vapor mixture in a fuel storage containment system, comprising the steps of:

measuring the pressure level in the fuel storage containment system;

compressing the air or vapor mixture in the fuel storage containment system when the pressure level of the fuel storage containment system exceeds a first threshold pressure level; and storing the compressed air or vapor mixture in a storage vessel coupled to the fuel storage containment system.

17. The method of claim 16, wherein said compressor pump is fluidly coupled to a component of the fuel storage containment system comprised from the group consisting of the fuel storage tank, the vent pipe, and the vapor return pipe.

18. The method of claim 16, further comprising preventing backflow of the air or vapor mixture from said storage vessel to the fuel storage containment system.

19. The method of claim 16, further comprising the step of not further performing said compressing step when the pressure level in the fuel storage containment system drops below a second threshold pressure level.

20. The method of claim 19, further comprising activating a drain valve between said storage vessel and the fuel storage containment system to release the air or vapor mixture in said storage vessel back to the fuel storage containment system when the pressure level in the fuel storage containment system falls below a third threshold pressure level to raise the pressure level in the fuel storage containment system.

21. The method of claim 20, further comprising deactivating said drain valve when the pressure level in the fuel storage containment system exceeds a fourth threshold pressure level.

22. The system of claim 20, further comprising deactivating said drain valve after a predetermined amount of time has passed after said step of activating said drain valve has been performed.

23. The system of claim 20, further comprising deactivating said drain valve after determining said storage vessel is empty.

24. The method of claim 23, wherein said step of determining said storage vessel is empty comprises measuring the pressure level inside said storage vessel.

25. The method of claim 20, further comprising regulating and limiting the pressure of the air or vapor mixture that is drained from said storage vessel to the fuel storage containment system.

26. The method of claim 16, further comprising deactivating said step of compressing if the pressure in said storage vessel exceeds a predetermined upper pressure level to prevent excessive pressure from building up inside said storage vessel.

* * * * *

UNITED STATES PATENT AND TRADEMARK OFFICE

CERTIFICATE OF CORRECTION

PATENT NO. : 6,840,292 B2
DATED : January 11, 2005
INVENTOR(S) : Robert P. Hart et al.

It is certified that error appears in the above-identified patent and that said Letters Patent is hereby corrected as shown below:

Title page,
Item [75], Inventors, address of "Kevin Hughes" should read
-- West Hartford, CT (US) --.

Signed and Sealed this

Twelfth Day of April, 2005

JON W. DUDAS
*Director of the United States Patent and Trademark Office*